US006762664B2

(12) United States Patent
Sander

(10) Patent No.: US 6,762,664 B2
(45) Date of Patent: Jul. 13, 2004

(54) HTS CRYOMAGNET AND MAGNETIZATION METHOD

(75) Inventor: Michael Sander, Eggenstein-Leopoldshafen (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 62 days.

(21) Appl. No.: 10/280,824

(22) Filed: Oct. 25, 2002

(65) Prior Publication Data

US 2003/0062899 A1 Apr. 3, 2003

Related U.S. Application Data

(63) Continuation-in-part of application No. PCT/EP01/05387, filed on Nov. 5, 2001.

(30) Foreign Application Priority Data

Jul. 12, 2000 (DE) ..... 100 33 869

(51) Int. Cl.[7] ..... H01F 6/00
(52) U.S. Cl. ..... 335/216
(58) Field of Search ..... 335/205–207, 335/216; 174/125.1

(56) References Cited

U.S. PATENT DOCUMENTS 5,227,755 A * 7/1993 Westphal et al. ..... 335/216
5,289,150 A * 2/1994 Rabinowitz ..... 335/216
5,812,042 A * 9/1998 Maki et al. ..... 335/216
6,020,803 A * 2/2000 Wheatley et al. ..... 335/216
2003/0098689 A1 * 5/2003 Marek ..... 324/318

FOREIGN PATENT DOCUMENTS

EP 0 649 151 4/1995

OTHER PUBLICATIONS

M. Sander et al., "Pulsed Magnetization of HTS Bulk Parts at T <77K", Superconductor Science and Technology, IOP Publishing, Techno House, Bristol, GB, vol. 13, No. 6, Jun. 2000.

Mizutani et al., "Pulsed–Field Magnetization Applied to High–$T_c$Superconductors", Applied Superconductivity, Pergamon Press, Exeter, GB, Feb. 5, 1998. pp. 235–246.

* cited by examiner

*Primary Examiner*—Lincoln Donovan
*Assistant Examiner*—Bernard Rojas
(74) *Attorney, Agent, or Firm*—Klaus J. Bach

(57) ABSTRACT

In a method and a kryomagnet for the pulsed magnetization of the kryomagnet which comprises discs stacked on top of one another, with each disc including concentric annular conductor elements arranged in axially spaced relationship and each conductor element having two contact points forming two arms between the contact points for their energization, a transport current impulse is applied to each conductor element which pulse is divided in each conductor element into first and second partial currents $I_1$ and $I_2$ to flow through the two arms from one of the contact points in an opposite sense to the other contact point, wherein one arm has a length of maximally 35% of the circumference of the conductor element, the transport current having a polarity such that the larger partial current flowing through the shorter arm while the transport current is increasing flows in all the conductor elements in the same direction.

23 Claims, 6 Drawing Sheets

HTS CRYOMAGNET AND MAGNETIZATION METHOD

This is a Continuation-In-Part application of international application PCT/EP01/05387 filed Nov. 5, 2001, and claiming the priority of German application No. 100 33 869.0 filed Jul. 12, 2000.

BACKGROUND OF THE INVENTION

The invention relates to a method for the pulsed magnetization of a high temperature superconductive (HTS) kryomagnet, which is operated below its transient temperature, and which consists of discs stacked along an axis and comprising each n annular or polygon-shaped concentric conductor elements of superconductive material with n−1 annular gaps formed between the n concentric conductor elements.

HTS massive material capable of carrying high currents can be used for kryomagnets as long as, after the magnetization, it is maintained at an operating temperature T below the transient temperature $T_c$, that is, $T<T_c$. Then the kryomagnet becomes, in effect, a permanent magnet. Its field is frozen. Fields of >14 Tesla have been demonstrated to exist after magnetization by large superconductive magnet coils by way of the "Field-Cooled" procedure. The procedure is, in principle, as follows:

Within the initially time-wise constant outer field of for example a superconductive coil, the HTS is cooled to a temperature $T<T_c$. At this temperature, the magnetic flux is frozen or captured. Then the outer magnetic field is reduced slowly that is on a scale of minutes and hours, whereby superconductive currents are induced in the HTS which substantially maintain the field in the HTS and which render the HTS in effect permanent magnetic that is, they form a kryomagnet.

The magnetization of HTS bodies capable of carrying high currents when installed in an electric machine cannot be performed by the use of a large superconductive coil but must be done by way of a pulsed magnetization using for example a Cu coil. In contrast to the above "field-cooled" procedure the superconductor is cooled by the so-called "zero field-cooled" process without outer field to a temperature $<T_c$ and is then subjected to a short magnetic field pulse. With sufficiently strong magnetic fields, magnetic flux can be frozen in the superconductor also with this process. The magnetization may also occur in successive magnetization steps by multiple successive pulsing of the magnetizing magnet. Multipurpose processes with pulse durations of several ms have been found to be advantageous in this connection in order to freeze magnetic fields of up to 3 Tesla.

Pulsed magnetizing processes using CU coils without coupled current pulses [I, II, III] as well as shaping and connecting techniques for HTS solid material [IV], HTS ring structures and their magnetic characterization [V] as well as mechanical reinforcements for accommodating the high forces [VI] generated by the strong magnetic fields and effective on the HTS, are known.

The saturation magnetization of a shaped body, that is, the maximum field H* that can be frozen is determined by the shape of the sample and by the critical current density thereof. As a general rule, with the field-cooled method the field of the coil must be at least 1×H* in order to fully magnetize the probe. With a pulsed magnetization however, that is, the zero field-cooled" procedure, typically a magnetic field of a pulse height 2×H* is necessary. The reason is that shielding currents are generated in the probe in the area of the rising flank of the magnetizing pulse,.

These shielding currents induced with the increasing flank of the magnetizing current pulse and the pulse fields of 3–6 Tesla maximally achievable with the installed Cu coils determine consequently the practical limits for frozen feeds maximally achievable.

If the induced shielding currents could be limited, ideally to zero, such a situation, which is comparable to the "field-cooled" process would not be reached. If furthermore the individual shaped bodies could be separately magnetized the fields generated by the individual segments would add up and, altogether fields could be obtained which are higher than those generated by the Cu coil.

It is therefore the object of the present invention to provide a magnetizing procedure for a kryo-HTS magnet whereby high magnetic fields can be frozen at temperatures below the transient temperature $T_c$ and to provide a kryomagnet which can be effectively magnetized in by this procedure.

SUMMARY OF THE INVENTION

In a method and a kryomagnet for the pulsed magnetization of the kryomagnet which comprises discs stacked on top of one another, with each disc including concentric annular conductor elements arranged in axially spaced relationship and each conductor element having two contact points forming two arms between the contact points for their energization, a transport current impulse is applied to each conductor element which pulse is divided in each conductor element into first and second partial currents $I_1$ and $I_2$ to flow through the two arms from one of the contact points, in an opposite sense, to the other contact point, wherein one arm has a length of maximally 35% of the circumference of the conductor element, the transport current having a polarity such that the larger partial current flowing through the shorter arm while the transport current is increasing flows in all the conductor elements in the same direction.

For a better understanding of the method, first the design specifically of the kryomagnet is shortly, described: The kryomagnet consists of m discs in a stack with the centers of the dics being all disposed on an axis. Each disc comprises n circular or polygonal conductor elements which are disposed concentrically in a plane and form therebetween n−1 annular gaps, m and n being natural numbers $\geqq 1$. The conductor elements consist of superconductive, or more specifically, high temperature superconductive material.

Each of the n conductor elements has two contact points by way of which it is energized during the magnetizing procedure below the lowest transient temperature $T_c$ of the respective used superconductive materials.

To each of the n conductor elements, a transport current impulse I pulse of a predetermined polarity strength and pulse form is supplied by way of its two contact points. From one contact point to the other of an energized conductor element, the transport current I pulse is separated into two partial currents $I_1$ through one arm of the conductor element to the other contact point and $I_2$ through the other contact arm of the conductor element to the other contact point. The two contact points are so arranged that the length of the connecting path therebetween that is, the length of the shorter of the two arms, comprises maximally 35% of the total circumference of the conductor element. In this way, a current asymmetry $I_1 \neq I_2$ is established. The current flowing in the longer arm will be designated $I_2$.

The m, n conductor elements are geometrically arranged and electrically so interconnected that the transport current impulse $I_{puls}$ introduced into each of the n conductor elements has such a polarity that the partial current $I_1$ has, in the area of the rising flank of the transport current impulse $I_{pulse}$, with respect to a predetermined sense the same direction in all n conductor elements. With the use of several discs, the transport current impulse $I_{pulse}$ supplied to the conductor elements is so selected that the partial current $I_1$ flowing during the increasing flank of the transport current pulse $I_{puls}$ has, with respect to a predetermined sense, in all discs the same direction.

Preferably, the transport current impulse is adjusted in all m, n conductor elements in such a way that the respective maximum value $I_{puls,mzx}$ is the same in each conductor element. The largest part of the length of the shorter arm of the full circumference of the closed conductor loop is designated for all m, n conductor elements with $A_{max}$. As critical current $I_c$ of a superconductive conductor element, the current is designated which generates in the superconductor a voltage drop of $10^{-6}$ V/cm. Currents $>I_c$ lead to a buildup of an ohmic resistance in the superconductor. The largest critical current of all the m, n conductor elements is designated $I_{c,max}$ and the magnetic field strength, which is generated by all m fully magnetized discs in the centers thereof is designated H*. Accordingly, the maximum value $I_{puls,\ max}$ of the transport current impulse $I_{puls}$ is so adjusted that the following condition if fulfilled:

$$(1-2A_{max})I_{puls,max}H^*/I_{C,max} \geqq 2H^*$$

The highest saturation magnetization is achieved in that by multiple repetition of the pulsed magnetizing procedure the remanent magnetic flux introduced into the kryomagnet is increased stepwise up to the saturation magnetization.

After each magnetization step, the operating temperature T is preferably reduced. This reduces the shielding effect especially of the conductor elements arranged on the outside and provides for an increased magnetization in the center of the kryomagnet (see reference III).

For the magnetization procedure described so far, no outer magnetic field generated by a copper coil installed in the system is necessary.

However, an outer magnetic field can be used for the magnetization. To this end, the kryomagnet system should include at least one copper coil. The axis of the outer magnetic field generated thereby coincides with the axis of the magnetic field, which has been frozen after magnetization.

The kryomagnet is exposed by way of the normally conductive coil to a magnetic field pulse $H_{puls}$ of predetermined polarity, strength and pulse form, which induces in each of the conductor elements an annular current $I_{ind}$. This shields the conductor element at least partially from the intrusion of the magnetic flux during the increasing pulse flank of the magnetic field. After reaching the maximum $H_{puls,\ max}$ the polarity of the induced annular current $I_{ind}$ reverses.

By way of the two contact points, additionally, a transport current impulse $I_{puls}$ of predetermined polarity, strength and pulse form is applied to the respective conductor elements, which impulse is divided into two partial currents upon entering the conductor element.

Polarity, strength, pulse form and time-succession of the two pulses $I_{puls}$ and $H_{puls}$ are so selected that their cooperation results in a current distribution $I_1 \neq I_2$ in the two arms of the annular conductor element. Below, the partial current, which results from the cooperation of the two currents $I_{puls}$ and $I_{ind}$ and which has the same polarity as the annular current $I_{ind}$ which has been induced during the increase of the magnet pulse flank, is designated $I_1$. This partial current $I_1$ is, during the rising impulse flank, larger than the partial current $I_2$, which flows in the other arm of the annular conductor element.

The magnetic field pulse $H_{puls}$ and the transport current pulse $I_{puls}$ are so selected that, during a time interval within the total pulse interval, at least the partial current $I_1$ is in the vicinity of the critical current $I_c$ of the respective conductor element or exceeds the critical current $I_c$. In this way, a higher ohmic resistance is built up which limits in the respective conductor element the maximum current and consequently reduces the shielding effect of the ring current $I_{ind}$ induced during the increasing pulse phase. As a result, the magnetic flux intrudes more strongly into the conductor loop and, after fading of the two pulses $I_{pula}$ and $H_{puls}$, a permanent superconductor current continues to flow in the conductor loop. In this way, a higher remanent magnetization is obtained than with the sole application of the magnetic field impulse $H_{puls}$.

With respect to the transport current impulse $I_{puls}$, the same conditions are set as during the magnetizing without outer magnetic field, that is, the magnetic field $H_{puls}$ and the transport current impulse $I_{puls}$ supplied to the mn conductor elements are so selected that the greater partial current $I_1$ flowing during the increasing flank of the transport current $I_{puls}$ has the same direction in all conductor elements and, consequently in all n discs.

The assymetry in the division of the currents $I_1$ and $I_2$ in a conductor element is determined by the different arm lengths. The polarity of the current impulse $I_{puls}$ is so selected that, during the rising flank of the current impulse $I_{puls}$, the larger partial current $I_1$ flows in the shorter arm.

Preferably in all mn conductor elements of all the m discs the transport current impulse $I_{puls}$ is so adjusted that the respective maximum value $I_{puls,max}$ of the magnetic field pulse $H_{puls}$, the largest part $A_{max}$ of all the conductor elements of the length of the shorter arm of the total circumference of the closed conductor loop, the largest critical current $I_{c,max}$ of all the mn conductor elements and the magnetic field strength H*, which is generated by all m fully magnetized discs in the centers thereof, are so selected that the following conditions are fulfilled:

$$I_{puls,max} < 2I_{c,max}$$

and $$H_{puls,max} + (1-A_{max})I_{puls,max}I_{puls,max}H^*/I_{c,max} \geqq 2H^*.$$

In a particular embodiment, the n conductor elements of one of the m discs are arranged in series with at least one copper coil. This makes it possible that the pulsed coil current or a part of the coil current can be used also as transport current pulse $I_{puls}$ in all n conductor elements. Depending on the dimensioning of the copper coil and the conductor cross-section of the n conductor elements, it may be necessary to limit the transport current impulse $I_{puls}$, that is, therefore to supply only a part of the total coil current to the conductor elements.

It is possible, for example, to arrange the m discs electrically in a series circuit such that the pulsed coil current or a part of the coil current passes through all the m discs as transport current pulse $I_{puls}$.

Preferably, the magnetic field pulse $H_{puls}$ and the transport current pulse $I_{puls}$ are generated by the discharge of a condenser into the coil arrangement. By way of a sufficiently fast electronic switch such as a thyristor or a power transistor the oscillation circuit of inductivity and capacity is divided at the predetermined point in time. In this way, only the first half of the developing natural oscillation is used for the magnetization and a fading out of the oscillation is prevented.

Preferably, the pulsed magnetization procedure is repeated multiple times whereby the remnant flux introduced into the kryomagnet is increased stepwise up to the saturation magnetization.

With this repeated pulsed magnetization, the operating temperature T is lowered with each magnetization step. As disclosed in the reference III, this procedure can be combined with lowered $H_{puls,max}$ values for the first magnetization pulses. The kryomagnet with which the magnetization is achieved only by its energization, comprises the following components:

It includes m stacked discs with a common axis. Each of the m stacked discs comprises n different concentric circular or polygon-shaped conductor elements of superconductive or, rather high temperature superconductive material, which are arranged concentrically in a plane. M and n are natural numbers each being ≧1. The number is determined by the technical application and the required magnetic properties of the kryomagnet.

Each conductor element of the kryomagnet has two contact points for its energization. The mn conductor elements consist of materials of the so-called SE, $Ba_2Cu_3O_x$ high temperature superconductors, in short, 123-HTS. SE represents the chemical element Y or a rare earth metal or a mixture thereof. Each conductor element may include chemical additives, which increase the current conducting capacity. The crystallographic c-axis of the 123-HTS material of each of the conductor elements of a disc is displaced maximally 10 degree from the axis of the disc.

The conductor elements may comprise one or several 123-HTS shaped bodies. With the use of several shaped bodies, the bodies are joined mechanically and superconductively by superconductive connections on the basis of a 123-HTS with low peritectic temperature. The crystallographic a-b lattice intersections of the 123-HTS and 123 HTS materials are turned in the disc plane relative to each other by maximally 10°.

A plurality of electric circuit arrangements may be utilized. For example, the m n conductor elements may be connected each separately to an electric power source. Or the n conductor elements of a disc are arranged in a series circuit with the electrical connections for the supply and return line connected to the outer and inner rings, respectively. The electrical connection between the conductor elements may be normally conductive or superconductive. With a stack of discs, the discs may be separately connected or they may be arranged in a series circuit.

The inclusion of a normally conductive coil in the HTS kryomagnet for generating the outer magnetic field will be explained below:

For the magnetizing process, it is, in principle, unimportant what type of normally conductive coil is used as long as the field geometry of coincidence of the kryomagnet axis and of the external magnetic field axis is established. A copper coil is technically most suitable based on the material and manufacturing properties.

Two types of coils may be used, that is, a solenoid extending at least partially around the kryomagnet, that is the stack of the n discs, and a planar spiral coil of copper with a maximum diameter corresponding to the that of the discs.

In an arrangement, which is advantageous with regard to material stresses, the HTS kryomagnet is disposed in a matrix consisting of wax or resin or epoxy or another polymer hydrocarbon compound which is suitable for the kryo requirements and still has plastic properties at such low temperatures. In this way, the mechanical stresses associated the magnetic fields can be at least partially compensated and the mechanical stresses on the HTS material or reduced.

The pulsed magnetizing procedure proposed herein and the corresponding kryomagnet design have the following advantages:

In the state of the art massive bodies or also annular conductor structures on the basis of 123-HTS are used which are magnetized by large superconductive magnetic coils or also by pulsed copper magnet coils. By the direct supply of transport currents $I_{puls}$ to the various conductor elements, higher frozen magnetic fields as compared to the prior art can be obtained with a cost-effective and space-saving pulsed magnetization.

The invention will be described below in greater detail on the basis of the accompanying drawings.

DESCRIPTION OF PREFERRED EMBODIMENTS

Figure 1:
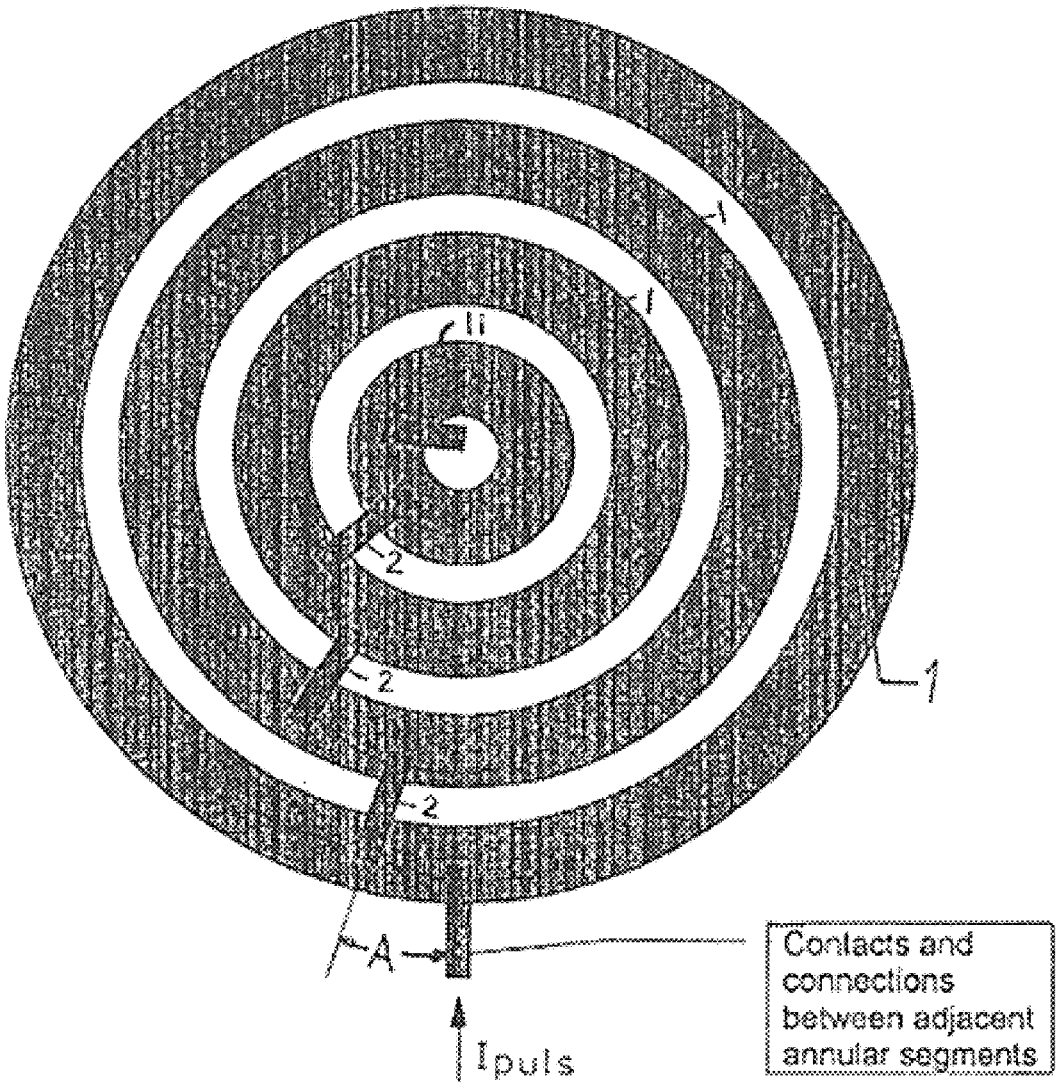
FIG. 1 shows schematically the arrangement of normally conductive annular conductor segments.

The kryomagnet is manufactured from a molded HTS body. A massive cylindrical body is cut into discs of, in the present case, a thickness of d=3 mm which are then cut into ring segments 1 of a width of Δr=2 mm by a laser cutting technique as shown in FIG. 1. The dimensions mentioned however are exemplary and may be different depending on technical requirements. The annular segments (rings) are interconnected by electrically normally conductive webs 2, which, electrically, form a knot.

The current pulse $I_{puls}$ applied to the outer ring segment 1 for the magnetization generates in each ring two partial currents $I_1$ and $I_2$, which are the result in the respective ring of the pulse current $I_{puls}$ and the induction current $I_{ind}$ generated by the magnetic field pulse $H_{puls}$. The respective partial currents in the rings are generally different. After the fading of the impulse current $I_{puls}$ and, if present, of the magnetic field impulse $H_{puls}$ an annular current $$I_1 - I_2 > OA$$

remains as a permanent current, which generates a magnetic field with the same polarity as $H_{puls}$. (In FIGS. 9 and 10, as examples, sine-like pulse forms of $I_{puls}$ and $H_{puls}$ are shown). By way of the geometric position of the webs/ connections 2 (FIGS. 1 and 2) the separation into the partial currents $I_1$ and $I_2$ of the respective ring may be influenced. Generally, this separation is asymmetric and is not the same in the different conductor elements. From the innermost ring the pulse current $I_{puls}$ returns again to the current source. The determination of a preferred direction is achieved in that the connecting distance between the points at which the current enters or, respectively, leaves a ring is only about A=20% (Typically 5–35%) of the total circumference of the ring (see FIGS. 9 and 10).

For a separate accession of the individual conductor elements, the magnetization can be established as follows:

Using a pulsed Cu coil or coils 3, first the innermost ring 11 is magnetized into which no current impulse is introduced, while the shielding effect of the outer rings is reduced during the whole magnetic field pulse $H_{puls}$ by the transport current pulses introduced into the outer rings. By means of several subsequent pulses, in this way, the various ring segments can be successively magnetized from the inside to the outside.

Figure 2:
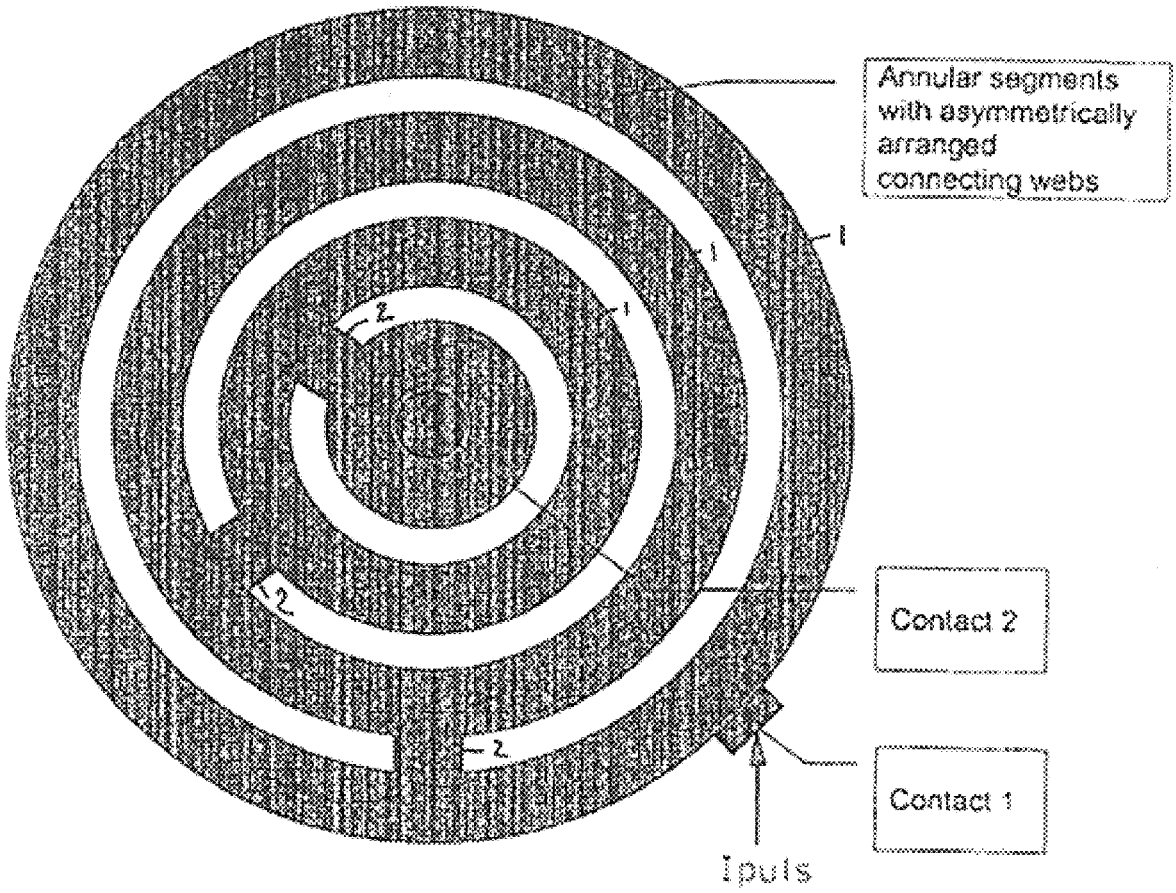
FIG. 2 shows an arrangement of superconductive annular conductor segments.

The arrangement shown in FIG. 2 corresponds to that of FIG. 1. In FIG. 2, the webs 2 consist of superconductive material, which is the same as that of which the rings 1 consist, or of another material. If the webs consist of the same super conductive material, the ring arrangement is preferably cut from a solid body by laser-cutting techniques since this material is very hard. In this way, the concentric ring arrangement is an integral body. The current distribution to the individual rings corresponds to that described in connection with FIG. 1.

Embodiments with a Cu coil include for example a Cu cylinder coil 3 with the HTS kryomagnet disposed in the interior thereof (FIGS. 3 to 5) or a sandwiched structure with Cu spiral coils 6 and HTS discs 5 disposed therebetween (FIGS. 6–8) which each consist of several rings. This embodiment facilitates the magnetization of the inner HTS ring segment because the magnetic field becomes stronger toward the center.

Figure 3:
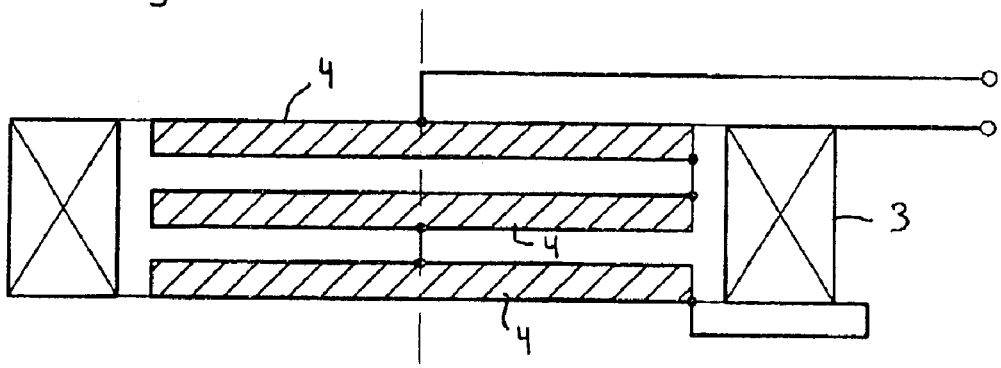
FIG. 3 shows HTS discs surrounded by a solenoid.

In the following FIGS. 3 to 8, the various magnetization setups are schematically shown which are considered to be particularly suitable:

For clarity reasons, only three stacked HTS discs are shown in FIG. 3, the arrangement of which corresponds to that shown in FIGS. 1 or 2. The disc arrangement is surrounded by solenoids 2 with copper coils. The three HTS discs 4 and the solenoid 3 are arranged in an electric series circuit, the three discs 4 being electrically interconnected by the shortest distances and the connection being established either by normally or superconductive connectors.

Figure 4:
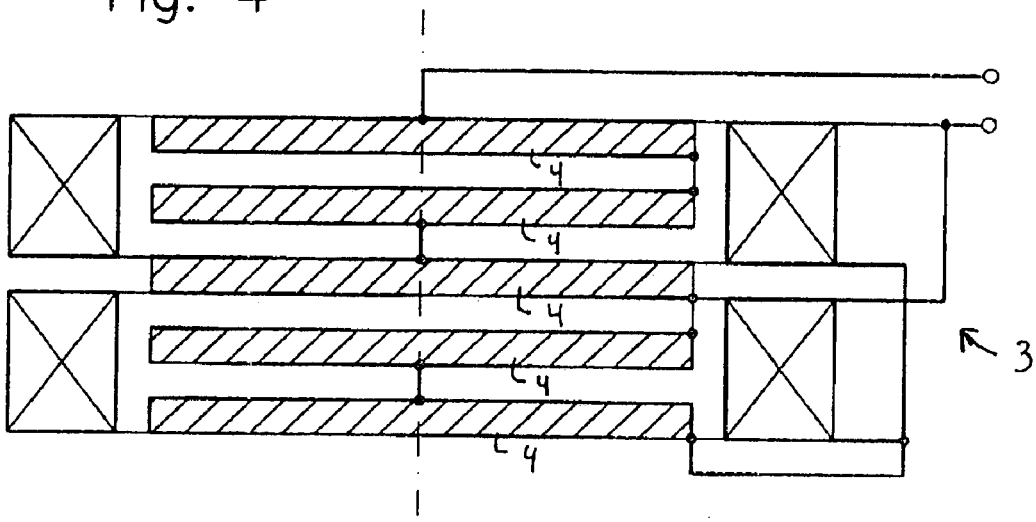
FIG. 4 shows HTS discs surrounded by two electrically parallel solenoids.

FIG. 4 shows a stack of five HTS discs, which are surrounded by two solenoids 3 disposed on top of one another. The five HTS discs 4 are connected in series like those shown in FIG. 3 and also in series with the two solenoids 3, wherein the solenoids however are arranged in parallel.

Figure 5:
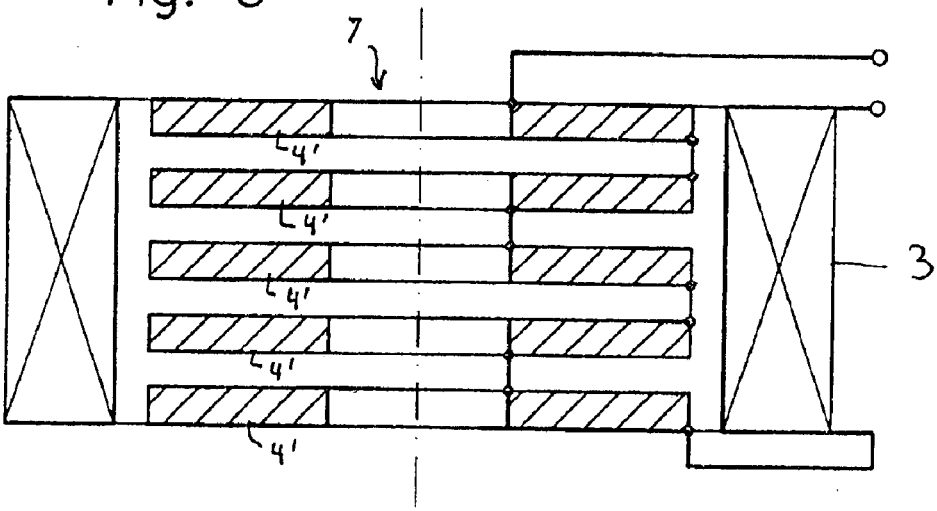
FIG. 5 shows annular HTS discs surrounded by a solenoid.

In the arrangement as shown in FIG. 5, the five HTS discs 4' are annular so that a cylindrical space 7 is formed along the axis of the discs 4'. The five annular discs are surrounded by a solenoid 3 of corresponding height. The circuit arrangement corresponds to that of FIG. 3.

Figure 6:
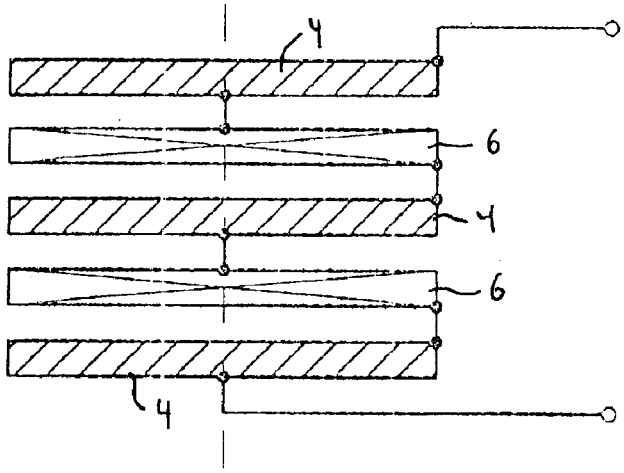
FIG. 6 shows an arrangement with alternate HTS discs and spiral coils.
Figure 7:
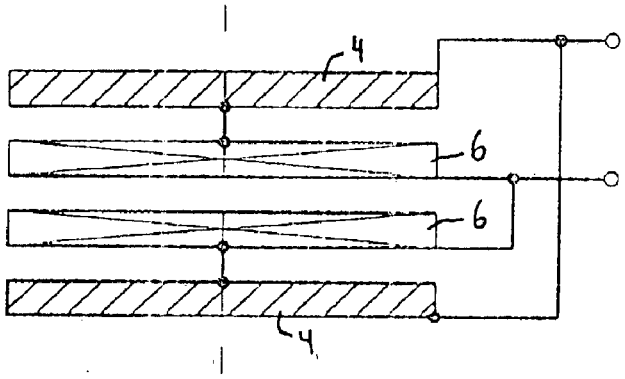
FIG. 7 shows an arrangement of HTS coils with spiral coils disposed therebetween.
Figure 8:
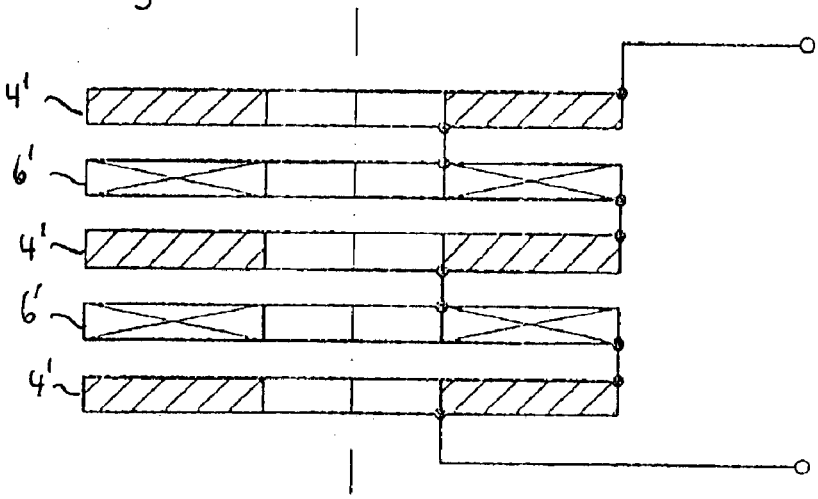
FIG. 8 shows an arrangement of alternately disposed HTS annular discs and spiral coils.

In the arrangements as shown in FIGS. 6 to 8, the magnetic field impulse $H_{puls}$ is generated by way of disc-like spiral coils 6. The spiral coils 6 are sandwiched between the HTS discs 4. Like in FIGS. 3 to 5, the magnetic field axis coincides with the axis of the HTS discs 4.

FIG. 6, for example, shows an arrangement, wherein three HTS discs 4 and two spiral coils 6 are stacked up in an alternating fashion. The HTS discs 4 and the spiral coils 6 have the same contour. But it would also be possible to make the diameter of the spiral coils 6 larger than that of the HTS discs 4 if only in this way a sufficiently strong magnetization of the discs can be achieved.

FIG. 7 shows an arrangement wherein the stack comprises two spiral coils 6 arranged adjacent each other between tow HTS discs 4. Each HTS disc 4 is electrically connected in a series circuit arrangement with the respective adjacent spiral coil 6 to form a group and the two groups are electrically connected in a parallel circuit.

If a hollow space is needed along the disc and magnetic field axes, the set up as shown in FIG. 8 is suitable. The three HTS annular discs 4' and the two annular disc coils 6' are stacked alternately and all are connected in an electrical series circuit.

Figure 9:
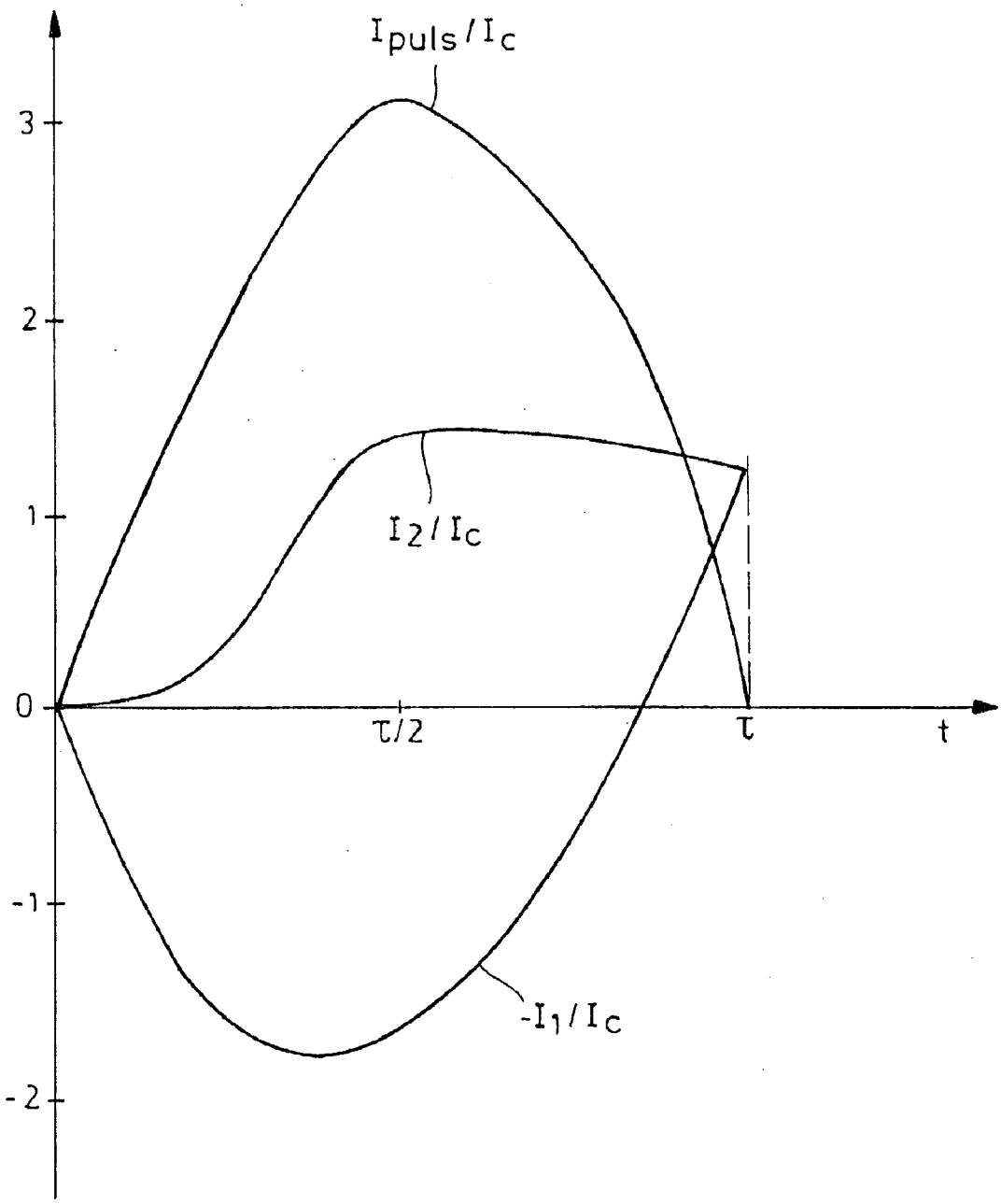
FIG. 9 shows the current pulses over time.

The possibilities as indicated in FIGS. 3 to 8 for various arrangements of series and parallel circuits with the coils and the HTS annular discs facilitate an optimal tuning of the coil currents and the current pulses introduced into the conductor elements to the critical current $I_c$ as determined by the conductor cross-section of the conductor elements. In this way, optimal magnetizing effects can be economically achieved. FIG. 9 shows schematically the pulse current $I_{puls}$ over time and the separated currents $I_1$ and $I_2$ in the ring in a normalized representation based on the critical current $I_c$ of the conductor element. The pulsed current introduced into the setup is sine-shaped. Here the magnetization occurs by the current, that is, without an externally applied magnetic field $H_{puls}$. The current is divided in a ring as shown. The current has a period duration $\tau$, which is the time from the beginning of the current rise to the first zero passage. At the first zero passage, the oscillation circuit consisting of an energy storage device (condenser/power supply) and inductivity of the setup is electronically split.

Figure 10:
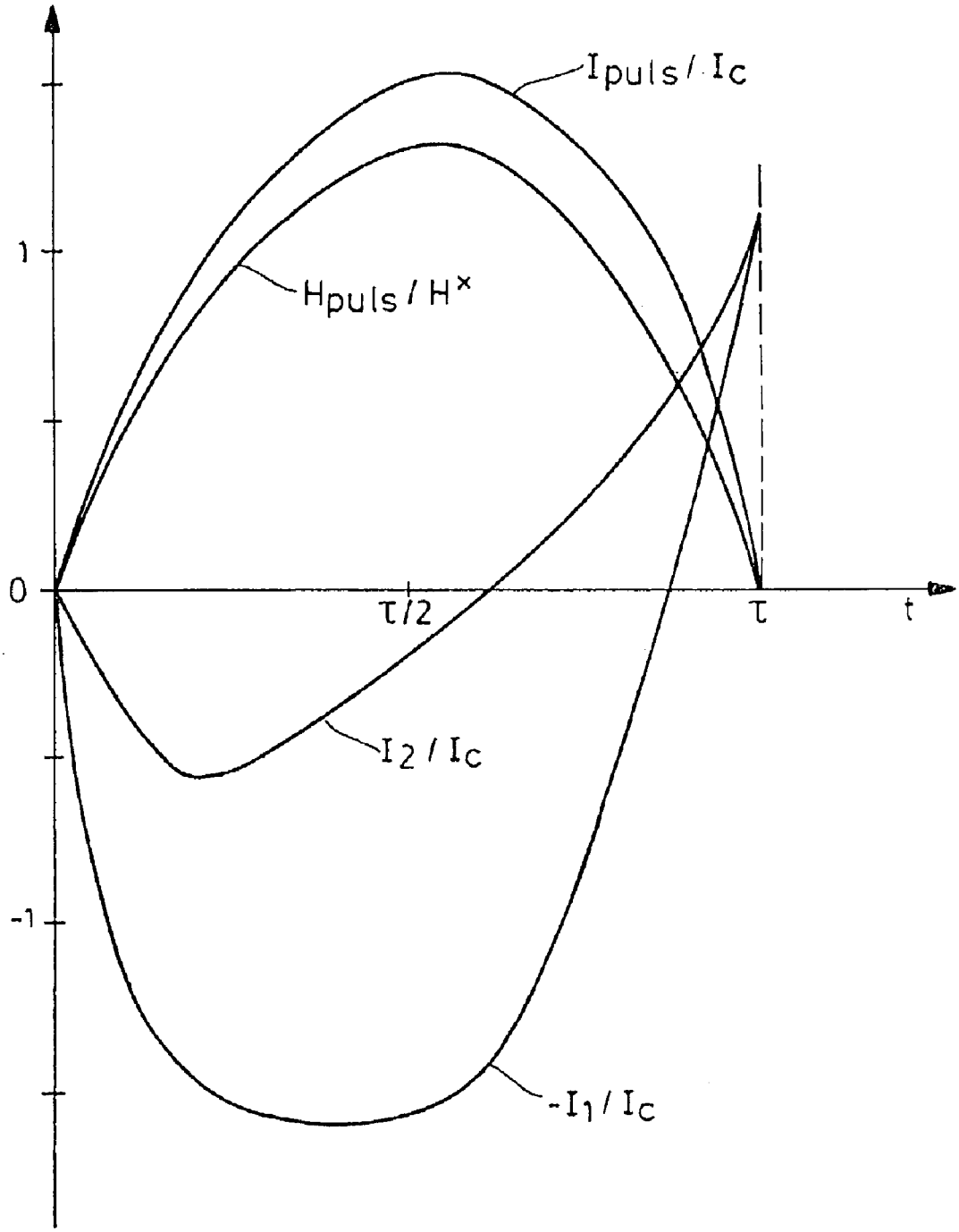
FIG. 10 shows the current and the magnet pulses over time.

FIG. 10 finally shows the magnetization by a pulse current as in FIG. 9 with an additional magnetic field. A normalized representation has also been selected for the sine-like magnet field pulse shown over time.

From both examples, it can be seen that, during the increase of the pulse flank, $I_1$ increases first substantially faster than $I_2$. Without an additional magnetic field pulse that is without an additional induced shielding current $I_{ind}$, $I_2$ always remains positive (in accordance with the arrangements for providing current flow directions as given in FIGS. 1 and 2). With an additional magnetic field pulse, the induced shielding current $I_{ind}$ first exceeds the part of $I_{puls}$, which is supplied to the longer arm of the conductor element, that is, $I_2$ is first negative based on the current directions as determined in FIGS. 1 and 2. However, as soon as $I_1$ exceeds $I_c$, the further increase is limited by $I_1$. Then $I_2$ increases. At the same time, magnetic flux can penetrate the annularly closed conductor element. In FIG. 9, the magnetic flux is built up by the current $I_2$ in the longer arm of the conductor element whereas in FIG. 10, it is mainly generated by an external magnetic field. During the drop of the pulse flank, the superconductor freezes the magnetic flux that has been established in the closed conductor loop. As a result, $I_1$ becomes negative and a loop current $I_1=-I_2$ flows in the loop in a positive $I_2$ direction wherein this loop current corresponds about to $I_c$, that is, the ring is fully magnetized.

Depending on the selected magnetization arrangement (FIGS. 3 to 8) and the selected circuit arrangement, the numbers for the various currents, magnetic fields and pulse durations can be varied in large ranges depending on the application. As a general rule, however, for the critical current $I_c$ of the conductor elements, values of several 100 to several 1000 A, magnetic field strengths $H_{puls,max}$ of up to 5T and pulse durations I of 1 to 100 ms are considered to be suitable.

LISTING OF REFERENCES

I IEEE TRANSACTIONES ON APPLIED SUPERCONDUCTIVITY, Vol. 9, No. 2, June 1999, pp. 916–919 "Beam Confinement Magnets Based on Single-Grain Y—Ba—Cu—O", A. C. Day et al.;

II Applied Superconductivity, Vol. 6, Nos. 2–5, pp. 235–246, 1998, "PULSED-FIELD MAGNETIZATION APPLIED TO HIGH-$T_c$ SUPERCONDUCTORS", U. Mizutani et al.;

III "Pulsed Magnetization of HTS Bulk Parts at T</77 K", M. Sander et al, Forschungszentrum Karlsruhe GmbH, sowie darin enthaltene Referenzen Supercond.Sci.Technol. 13 (2000) 1–5

IV Referenz E aus EM 92/99: Shaping Vorabdruck Proc. European Conference on Applied Superconductivity '99, Barcelona 13.–17.9.1999, erscheint in Applied Superconductivity "Properties of Melt-Textured Y123 Ring Structures", H. Claus et al. Workshop on Bulk High Temperature Superconductors and their Applications, 17.–19.5. 1999, Argonne National Laboratory . . . .

VI Referenz A aus EM 92/99: Improvement . . . Vorabdruck Proc. European Conference on Applied Superconductivity '99, Barcelona 13.–17.9. 1999, erscheint in Applied Superconductivity

What is claimed is:

1. A method for the pulsed magnetization of a kryomagnet operated below a transition temperature $T_c$ at which the magnet material becomes superconductive, said magnet comprising m discs stacked on top of one another along an axis, each disc including n annular conductor elements arranged concentrically within a plane and in spaced relationship so as to form n−1 annular gaps therebetween, each of said conductor elements having two contact points for energization thereof, said method comprising the steps of: supplying a transport current pulse $I_{puls}$ of predetermined polarity, strength and pulse form to each of the mn conductor elements by way of one of the contact points thereof which current pulse is divided in each conductor element into a first partial current $I_1$ through one arm of the conductor element to the other contact point and a second partial current $I_2$ through the other arm to said other contact point, said one arm extending between said contact points in one direction having a length A of maximally 35% of the circumference of said conductor element so as to provide for different lengths of the two arms and causing a current asymmetry wherein $I_1 \neq I_2$, said mn conductor elements being electrically interconnected such that the transport current impulse $I_{puls}$ introduced into each of the n conductor elements has such a polarity that the larger partial current $I_1$ flowing while the transport current pulse is rising flows in all n conductor elements in the same direction.

2. A method according to claim 1, wherein said transport current pulse current $I_{puls}$ is adjusted in all mn conductor elements such that a respective maximum value $I_{puls,max}$ is the same in each of said conductor elements, the maximum value $I_{puls,max}$ is so adjusted that the largest part $A_{max}$ of the length of the shorter arm of the circumference of the closed conductor loop and the largest critical current $I_{c,max}$ of all the conductor elements and the magnetic field strength H*, which is generated by all m fully magnetized discs in the centers thereof, fulfill the conditions $$(1-2A_{max})I_{puls,max}H^*/I_{c,max} \geqq 2H^*.$$

3. A method according to claim 2, wherein the pulsed magnetization procedure is repeated multiple times whereby a remanent magnetic flux established in the kryomagnet is increased stepwise up to the saturation magnetization.

4. A method according to claim 3, wherein, after each magnetization step, the temperature T of the kryomagnet is reduced.

5. A method for the pulsed magnetization of a kryomagnet operated below a transition temperature at which the magnet material becomes superconductive, said magnet comprising m discs stacked along an axis, each disc including n annular concentric conductor elements of superconductive material arranged in spaced relationship so as to form n−1 annular gaps therebetween, each of said conductor element having two contact points for the energization thereof, and a normally conductive coil associated with said stack of m discs of n concentric superconductive annular conductors in such a way that the axis of the magnetic field generated upon energization of said normally conductive coil coincides with the axis of said stack of discs, said method comprising the steps of: energizing said normally conductive coil so as to generate a magnetic field pulse $H_{puls}$ of predetermined polarity, strength and pulse form to which said kryomagnet is exposed, said magnetic field pulse generating in each of the conductor elements an annular current $I_{ind}$ which induces an increasing magnetic field and, during the field increase, protects the conductor element at least partially from an intrusion of magnetic flux and whose polarity reverses when the maximum $H_{puls,max}$ has been reached, supplying to the conductor elements by way of one of their two contact points additionally a transport impulse $I_{puls}$ of predetermined polarity, strength and pulse form which, upon entering a conductor element, is divided into two partial currents $I_1$ and $I_2$, which flow by way of the two arms of the annular conductor element to said second contact point and selecting the polarity, strength, pulse form and the succession of the two pulses $I_{puls}$ and $H_{puls}$ such that a current distribution $I_1 \neq I_2$ is obtained in the two arms of the annular conductor elements wherein the partial current $T_1$, which results from a cooperation of the two currents $I_{puls}$ and $I_{ind}$, has the same polarity as the annular current $I_{ind}$ induced during the rise of the magnetic pulse, and which, during this period, is greater than the partial current $I_2$ which flows in the second arm of the annular conductive magnet, and furthermore selecting the magnetic pulse $H_{puls}$ and the transport current pulse $I_{puls}$ such that, during a time interval within the total pulse interval, at least the partial current $I_1$ reaches the vicinity of, or exceeds, the critical current $I_c$ of the respective conductor element, the n conductor elements of a disc being electrically so interconnected that the transport current impulse $I_{impuls}$ supplied to each of the n conductor elements has a polarity such that the larger partial current $I_1$ flowing during the increase of the transport current impulse $I_{impuls}$ has the same direction in all in discs.

6. A method according to claim 5, wherein the current flow through the two arms of each current conductor that is, the division into the partial flows $I_1$ and $I_2$ flows through the shorter arm during the rise of the current pulse.

7. A method according to claim 6, wherein the transport current pulse $I_{puls}$ in all the nm conductor elements of all the m discs is so adjusted that the respective maximum current pulse value $I_{puls,max}$ is the same in each conductor element and wherein the maximum pulse value $H_{puls,max}$ of the magnetic field pulse $H_{puls}$, the maximum value $I_{puls,max}$ of the current pulse $I_{puls}$, the largest part $A_{max}$ of the length of the shorter arm at the circumference of the closed conductor loop, the largest critical current $I_{c,max}$ of all the mn conductor elements, and the magnetic field strength H*, which is generated in the center of all of the m fully magnetized discs are so selected that the following conditions are maintained:

$$I_{puls,max}<2I_{c,max}$$

and $$H_{puls,max}+(1-A_{max})I_{puls,max}\,H^*/I_{c,max}\geqq 2H^*.$$

8. A method according to claim 6, wherein the transport impulse $I_{puls}$ is adjusted in all the conductor elements of all the m discs such that the respective maximum value $I_{puls,max}$ is the same in each conductor element, and the maximum value of the magnetic field pulse $H_{puls,max}$, the maximum value of the current pulse $I_{puls,max}$, the largest part $A_{max}$ of the length of the shorter arm at the circumference of the shorter arm at the circumference of the closed conductor loop, the largest critical current $I_{c,max}$ of all the conductor elements and the magnetic field strength H* of all in fully magnetized discs generated in the centers thereof, fulfill the following conditions:

$$I_{puls}\geqq 2I_{c,max}$$

and $$2H_{puls,max}+(1-2A_{max})I_{puls,max}H^*/I_{c,max}\geqq 2H^*.$$

9. A method according to claim 7, wherein said n conductor elements of one of the m discs are arranged in an electrical series circuit with at least one copper coil whereby the pulsed coil current or part of the coil current flows as transport current pulse $I_{puls}$ in all the n conductor elements.

10. A method according to claim 9, wherein said m discs are arranged in a series circuit so that the pulsed coil current or part of the coil current is conducted as transport current impulse $I_{puls}$ through all m discs.

11. A method according to claim 9, wherein the magnetic field pulse $H_{puls}$ and the transport current impulse $I_{puls}$ are generated by discharging a condenser into the coil arrangement and only the first half of the pulse is maintained for the magnetization step while the second half is switched off.

12. A method according to claim 11, wherein the pulsed magnetization procedure is repeated multiple times whereby the remanent magnetic flux generated is increased in a stepwise fashion up to the saturation magnetization.

13. A method according to claim 12, wherein the operating temperature of the kryomagnet is further lowered with each magnetization step.

14. A kryomagnet on the basis of a body of super conductive material, comprising m discs stacked on top of one another along a center axis of said discs, each disc comprising n annular conductor elements disposed concentrically in a plane in spaced relationship from each other, so as to form n−1 annular gaps, contact webs extending between adjacent annular conductor elements across said gaps and interconnecting adjacent annular conductors at predetermined contact points for energizing said annular conductors, said mn annular conductor elements consisting of superconductive material from the class of the SE, $Ba_2Cu_3O_x$ high temperature superconductors, 123 HTS, wherein SE represents the chemical element Y or a rare earth metal or a mixture of these materials and selected chemical additives which increase the current carrying capacity, said 123-HTS-materials of each of the n conductor elements of a disc having a crystallographic c-axis, which deviates from the axis of the respective disc by not more than 10 degrees, and said mn conductor elements being interconnected by superconductive connectors on the basis of 123 HTS with low preritectic temperature and the crystallographic a-b-lattice intersections of the 123-HTS and 123-HTS' materials in the disc plane being turned with respect to each other by not more than 10°.

15. A kryomagnet according to claim 14, wherein said mn conductor elements are each separately connected to a current source.

16. A kryomagnet according claim 14, wherein said n conductor elements of a disc are arranged in an electrical series circuit and the current supply is connected to one of the outermost and innermost conductor elements while the return is connected to one of the innermost and outermost conductor elements respectively.

17. A kryomagnet according to claim 16, wherein said m discs are each separately connected to a current source.

18. A kryomagnet according to claim 16, wherein said m discs are arranged in an electrical series circuit.

19. A kryomagnet according to claim 14, wherein said kryomagnet includes a copper coil so arranged that the axes of the magnetic fields of said discs and said copper coil coincide.

20. A kryomagnet according to claim 19, wherein said copper coil is a solenoid extending around at least one disc of said stack of discs.

21. A kryomagnet according to claim 19, wherein said copper coil is a planar spiral coil with an outer diameter equal the diameter of said discs and is disposed axially adjacent at least one of said discs.

22. A kryomagnet according to claim 14, wherein said HTS krymagnet is disposed in a matrix of a compound of the group consisting of wax, resin, epoxy and other polymer hydrocarbon compound which, at kryogenic temperatures, remains sufficiently plastic to accommodate the mechanical stresses resulting from the magnetic fields.

23. A kryomagnet according to claim 14, wherein the two electrical contact points for the transport current $I_{puls}$ are so provided at each of the nm conductor elements, that the length of one of the two arms of the current conductors extending between them has a length of not more than 35% of the circumference of the conductor element.

* * * * *